US007161450B2

(12) United States Patent
Takenaka

(10) Patent No.: US 7,161,450 B2
(45) Date of Patent: Jan. 9, 2007

(54) MICROWAVE TRANSMISSION LINE HAVING DIELECTRIC FILM LAYERS PROVIDING NEGATIVE SPACE CHARGE EFFECTS

(75) Inventor: Tsutomu Takenaka, Tokyo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 64 days.

(21) Appl. No.: 11/033,803

(22) Filed: Jan. 13, 2005

(65) Prior Publication Data

US 2005/0156691 A1 Jul. 21, 2005

(30) Foreign Application Priority Data

Jan. 20, 2004 (JP) ..... 2004-011373
Dec. 1, 2004 (JP) ..... 2004-348876

(51) Int. Cl.
*H01P 3/08* (2006.01)

(52) U.S. Cl. ..... 333/238; 257/664

(58) Field of Classification Search ..... 333/1, 333/238; 257/664
See application file for complete search history.

(56) References Cited

U.S. PATENT DOCUMENTS 5,986,331 A * 11/1999 Letavic et al. ..... 257/664

FOREIGN PATENT DOCUMENTS

JP 03-210803 9/1991
JP 8-316420 11/1996

OTHER PUBLICATIONS

Gamble, H.S., et al. "Low-loss CPW Lines on Surface Stabilized High Resistivity Silicon." IEEE Microwave and Guided Wave Letter, IEEE Inc, New York, US, Vol. 9, No. 10, Oct. 1999, pp. 395-397.

Reyes, Adolpho C., et al. "Coplanar Waveguide and Microwave Inductor on Silicon Substrates." IEEE Transactions on Microwave Theory and Techniques, vol. 43, No. 9, Sep. 1995, pp. 2016-2022.

Wu, Yunhong., et al. "SiO2 Interface Layer Effects on Microwave loss of high-Resistivity CPW-Line." IEEE Microwave and Guided Wave Letter, vol. 9, No. 1, Jan. 1999, pp. 10-12.

* cited by examiner

*Primary Examiner*—Benny Lee
(74) *Attorney, Agent, or Firm*—McDermott Will & Emery LLP

(57) ABSTRACT

A microwave transmission line includes a substrate of high-resistivity silicon, a first dielectric film and a second dielectric film successively formed on the principal surface of the substrate and having different compositions, and a conductor film formed with at least the first dielectric film interposed between the conductor film and the substrate. One of the first and second dielectric films has positive space charges and the other has negative space charges. A signal electric field propagates through the substrate, the first dielectric film and the second dielectric film.

11 Claims, 8 Drawing Sheets

MICROWAVE TRANSMISSION LINE HAVING DIELECTRIC FILM LAYERS PROVIDING NEGATIVE SPACE CHARGE EFFECTS

CROSS-REFERENCE TO RELATED APPLICATIONS

The disclosure of Japanese Patent Application Nos. 2004-11373 and 2004-348876 filed on Jan. 20, 2004 and Dec. 1, 2004 including specification, drawings and claims is incorporated herein by reference in its entirety.

BACKGROUND OF THE INVENTION (1) Field of the Invention

The present invention relates to a microwave transmission line, and more particularly relates to a microwave transmission line formed on a high-resistivity silicon substrate.

(2) Description of Related Art

Microwave radio communication apparatuses and microwave radio communication terminals are being used in many fields, notably for consumer use. Group III-V compound semiconductors are often used for semiconductor substrates on which microwave front-end circuits of such radio communication apparatuses are formed. The reason for this is not only that active elements formed on compound semiconductor substrates each have an excellent high-frequency characteristic but also that such semi-insulating substrates can facilitate providing low-loss microwave transmission lines. On the other hand, Group III-V compound semiconductor substrates have the following demerits: their prices are high; since an intermediate-frequency (IF) stage and a signal processing part of such a radio communication apparatus are formed on a semiconductor substrate usually made of silicon (Si), the IF stage and the signal processing part cannot be integrated with a microwave front-end circuit; the yield of elements formed on the Group III-V compound semiconductor substrate tend to be lower than that of elements formed on a silicon substrate; and Group III-V compound semiconductor substrates each have a low thermal conductivity. These demerits have promoted the growth of the needs for forming microwave front-end circuits on silicon substrates.

A silicon substrate fabricated by a typical Czochralski (CZ) method has a resistivity of 100 Ωcm or less and is thus inadequate to a substrate for a microwave transmission line. On the other hand, a high-resistivity $p^-$-type silicon substrate fabricated by a floating zone (FZ) method can provide a high resistivity of 2 kΩcm or more. In theory, as long as the substrate serving as a medium through which a signal electric field of a microwave transmission line propagates has a resistivity of the similar value, a low-loss microwave transmission line should be able to be constructed which is close to a semi-insulating substrate of gallium arsenide (GaAs).

In spite of this, a problem actually arises in that a charge inversion layer is produced on a silicon substrate so that a high-resistivity $p^-$-type silicon substrate has a significantly reduced resistivity in vicinity of its top surface.

A natural oxide film is produced on the top surface of a silicon substrate, resulting in the changed physical properties of silicon. Therefore, a silicon oxide film is generally previously formed, as a protective film, on the silicon substrate. In this case, electrons, minority carriers, are stored at the interface between the $p^-$-type silicon substrate and the silicon oxide film and in the vicinity thereof. The reason for this is as follows: positive interfacial charges are produced at the interface between the silicon oxide film and the silicon substrate; positive charges are produced due to the surface level obtained by impurities of the silicon substrate; and the silicon oxide film itself becomes positively charged by impurities, i.e., sodium (Na) ions. It is considered that the above-mentioned storage of electrons will provide, in the vicinity of the top surface of the $p^-$-type silicon substrate, a charge inversion layer having a small thickness not more than 0.03 mm but having a reduced resistivity of approximately 0.03 Ωcm. This makes it difficult to realize a low-loss microwave transmission line, even with the use of a high-resistivity $p^-$-type silicon substrate.

For example, Document 1 (A. C. Reyes, et al., "Coplanar Waveguides and Microwave Inductors on Silicon Substrates", IEEE Trans. on Microwave Theory and Tech., vol. 43, No. 9, September, 1995) discloses the following configuration. A strip conductor of a microwave transmission line is arranged with a barrier metal interposed between a $p^-$-type silicon substrate and the strip conductor without providing a silicon oxide film on the substrate.

Furthermore, Document 2 (Y. Wu, et al., "$SiO_2$ Interface Layer Effects on Microwave Loss of High Resistivity CPW Line", IEEE Microwave and Guided Wave Letters, Vol. 9, No. 1, January, 1999) discloses the following configuration. A low-loss microwave transmission line similar to a gallium arsenide substrate is achieved by removing a part of a silicon oxide film other than that located under the microwave transmission line to restrain a charge inversion layer from being produced in a part of the microwave transmission line to which an electric field is applied. However, for both Documents 1 and 2, long-term stability and long-term reliability might not sufficiently be achieved, because $p^-$-type silicon substrates in both cases are exposed.

Furthermore, Document 3 (Japanese Unexamined Patent Publication No. 8-316420) discloses the following technique: a positive charge layer is formed on the top surface of a $p^-$-type silicon substrate by previously implanting boron (B) ions into the substrate, and negative charges stored in the $p^-$-type silicon substrate are cancelled by positive space charges arising from impurity (Na) ions contained in a silicon oxide film, thereby restraining a charge inversion layer from being produced.

With the method of Document 3, an annealing process is required for activating the ion-implanted boron and requires the heating of the substrate at 800° C. or more. If a transistor, a diode or the like has been formed on the $p^-$-type silicon substrate, doped impurities might be thermally diffused into the substrate or thin films already formed might peel off. Furthermore, since ions need be implanted into the substrate at least before the formation of at least the silicon oxide film, this makes it difficult to optimize the dosage of impurity ions while monitoring the thickness of the produced charge inversion layer.

SUMMARY OF THE INVENTION

The present invention is made to solve the above mentioned conventional problems, and its object is to allow a microwave transmission line using a silicon substrate as a signal propagation medium to prevent increase in transmission loss while maintaining long-term stability.

In order to achieve the above object, a microwave transmission line of the present invention is constructed by stacking a first dielectric film and a second dielectric film which produce space charges with different polarities between a high-resistivity substrate of silicon and a conductor film.

More specifically, a microwave transmission line of the present invention comprises: a substrate of high-resistivity silicon; a first dielectric film and a second dielectric film successively formed on the principal surface of the substrate and having different compositions; and a conductor film formed with at least the first dielectric film interposed between the conductor film and the substrate, wherein one of the first and second dielectric films has positive space charges and the other has negative space charges, and a signal electric field propagates through the substrate, the first dielectric film and the second dielectric film.

According to the microwave transmission line of the present invention, potentials are combined and thus neutralized in the vicinity of the principal surface of the substrate by interaction between positive and negative space charges produced by the first and second dielectric films successively formed on the principal surface of the substrate. This prevents carriers from being stored in the vicinity of the principal surface of the substrate. Therefore, a charge inversion layer reducing the resistivity of the substrate will not be formed in the vicinity of the principal surface of the substrate. Since the principal surface of the substrate is covered with the plurality of dielectric films, the microwave transmission line of the present invention can prevent increase in transmission loss while maintaining long-term reliability.

According to the microwave transmission line of the present invention, it is preferable that of the first and second dielectric films, the dielectric film having positive space charges is made of silicon oxide ($SiO_2$) and the other dielectric film having negative space charges is made of aluminum oxide ($Al_2O_3$). Silicon oxide can be produced on the substrate with stability and has excellent long-term stability, because the substrate is made of silicon. Therefore, silicon oxide is preferably used for the first dielectric film formed directly on the substrate. Furthermore, while the presence of Na ions serving as an impurity allows silicon oxide to have positive space charges, aluminum oxide empirically has negative space charges. Therefore, potentials are combined and thus neutralized in the vicinity of the principal surface of the substrate by silicon oxide and aluminum oxide. This prevents carriers from being stored in the vicinity of the principal surface of the substrate.

According to the microwave transmission line of the present invention, the thickness of each of the first and second dielectric films is preferably adjusted to neutralize potentials in the vicinity of the top surface of the substrate.

According to the microwave transmission line of the present invention, the first and second dielectric films are preferably stacked alternately one after the other to neutralize potentials in the vicinity of the top surface of the substrate. When dielectric films having different compositions are stacked, the dielectric films might peel off due to internal stresses. However, if as described above dielectric films have a three-or-more-layer structure, this can prevent the dielectric films from peeling off.

According to the microwave transmission line of the present invention, the second dielectric film is preferably formed only in a region having a high signal electric field intensity.

It is preferable that the microwave transmission line of the present invention further comprises a grounding conductor film formed on the opposite surface of the substrate to the principal surface thereof. This allows a microwave transmission line to have a so-called microstrip structure.

In this case, preferably, the microwave transmission line of the present invention further comprises a third dielectric film and a fourth dielectric film successively formed between the substrate and the grounding conductor film and having different compositions, wherein one of the third and fourth dielectric films has positive space charges, and the other has negative space charges.

Furthermore, in this case, it is preferable that of the third and fourth dielectric films, the dielectric film having positive space charges is made of silicon oxide and the other dielectric film having negative space charges is made of aluminum oxide.

According to the microwave transmission line of the present invention, the conductor film is preferably composed of a first conductor film and a second conductor film formed apart from and parallel to each other on the principal surface of the substrate. This allows a microwave transmission line to have a so-called strip structure or slot structure.

Preferably, the microwave transmission line of the present invention further comprises grounding conductor films formed to both sides of the conductor film on the principal surface of the substrate, respectively, said grounding conductor films being formed apart from the conductor film. This allows a microwave transmission line to have a so-called coplanar structure.

In this case, the second dielectric film is preferably formed only in a region having a high signal electric field intensity.

According to the microwave transmission line of the present invention, it is preferable that the conductivity type of the substrate is a p type and the substrate has a majority carrier density of $1\times10^{13}$ $cm^{-3}$ or less.

According to the microwave transmission line of the present invention, the conductor film is preferably connected to at least one of a transistor, a diode, a resistor element, a capacitor element, and an inductor element all formed on the principal surface of the substrate.

DETAILED DESCRIPTION OF THE INVENTION (Embodiment 1)

A first embodiment of the present invention will be described hereinafter with reference to the drawings.

Figure 1:
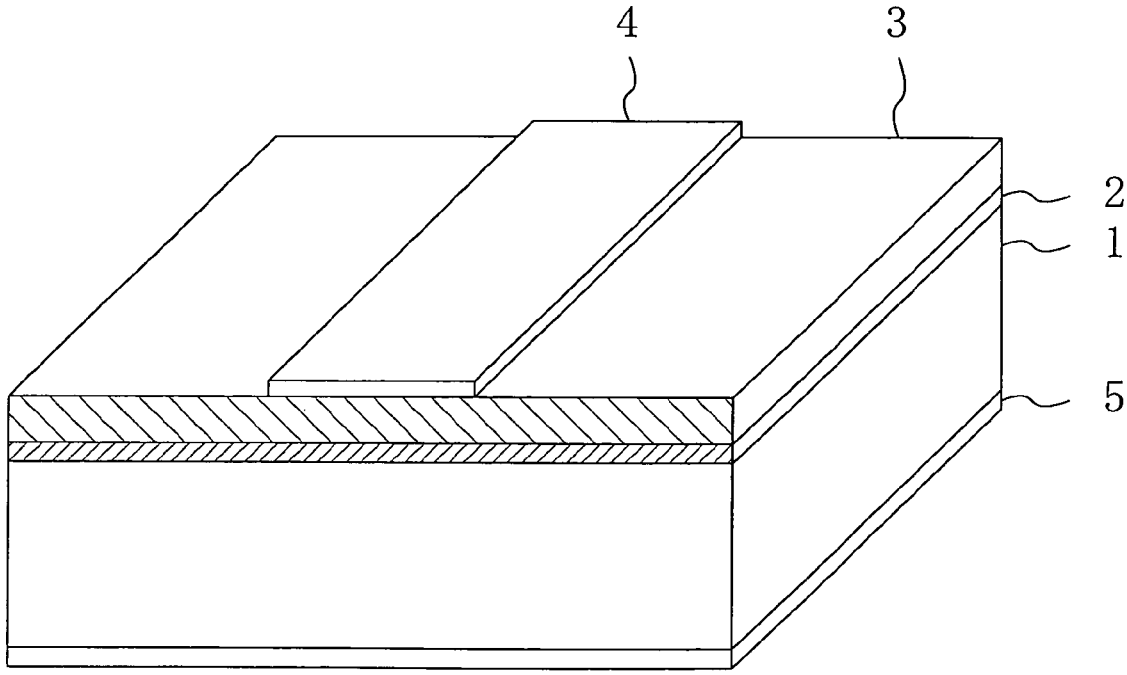
FIG. 1 is a cross-sectional perspective view illustrating a microwave transmission line according to a first embodiment of the present invention, i.e., a microstrip line.

FIG. 1 partly illustrates the cross-sectional structure of a microwave transmission line according to a first embodiment of the present invention, i.e., a microstrip line. As illustrated in FIG. 1, an approximately 50-nm-thick protective film 2 of silicon oxide ($SiO_2$) serving as a first dielectric film and an approximately 500-nm-thick potential neutralizing film 3 of aluminum oxide ($Al_2O_3$) serving as a second dielectric film are successively formed on the principal surface of an approximately 100-μm-thick high-resistivity substrate 1 of high-resistivity $p^-$-type silicon having a majority carrier (hole) density of approximately $1\times10^{13}$ $cm^{-3}$ or less.

An approximately 40-μm-wide strip metal 4 of, for example, gold (Au), aluminum (Al) or the like is formed on the potential neutralizing film 3, and a grounding metal 5 of, for example, gold (Au), aluminum (Al) or the like is formed on the opposite surface (back surface) of the high-resistivity substrate 1 to the strip metal 4.

In this way, a microstrip line using, as the signal propagation media, the high-resistivity substrate 1 of $p^-$-type silicon, the protective film 2 of silicon oxide and the potential neutralizing film 3 of aluminum oxide is formed of the strip metal 4 and the grounding metal 5.

The thickness of the potential neutralizing film 3 is set such that potentials are neutralized in the vicinity of the top surface of the high-resistivity substrate 1 by interaction among the following charges: positive space charges located in the protective film 2 and, for example, arising from Na ions; negative space charges located in the potential neutralizing film 3; and positive space charges produced at the interface between the protective film 2 and the high-resistivity substrate 1 and arising from impurity ions implanted into the high-resistivity substrate 1. For example, when as described above the protective film 2 has a thickness of 50 nm, the potential neutralizing film 3 has a thickness of approximately 500 nm.

With this structure, carriers are not stored in the vicinity of the interface between the high-resistivity substrate 1 and the protective film 2. This can suppress the production of a charge inversion layer which is produced in the vicinity of the interface and reduces the resistivity of the high-resistivity substrate 1. As a result, the stacked protective film 2 and potential neutralizing film 3 can prevent transmission loss from increasing with long-term stability maintained.

Silicon oxide constituting the protective film 2 can easily be formed by a thermal oxidation process under an oxygen atmosphere. In addition, silicon oxide obtained by thermal oxidation has a dense film quality, leading to excellent long-term stability. On the other hand, aluminum oxide constituting the potential neutralizing film 3 can be formed at a relatively low temperature of 400° C. or less by sputtering or the like. Therefore, even when an active element is previously formed on the high-resistivity substrate 1, the active element is not thermally damaged in forming a transmission line. As a result, the stacked protective film 2 and potential neutralizing film 3 of the microstrip line according to the first embodiment can prevent transmission loss from increasing with long-term stability maintained.

In this embodiment, the protective film 2 of silicon oxide is formed on the high-resistivity substrate 1 and the potential neutralizing film 3 is formed on the protective film 2. However, the potential neutralizing film 3 may be formed on the high-resistivity substrate 1 and the protective film 2 may be formed on the potential neutralizing film 3. In this case, the protective film 2 of silicon oxide can be formed by chemical vapor deposition (CVD).

Furthermore, a material of the potential neutralizing film 3 is not limited to aluminum oxide and may be a dielectric material having negative space charges. For example, aluminum nitride (AIN) can be used thereas.

(Modification 1 of Embodiment 1)

A first modification of the first embodiment of the present invention will be described hereinafter with reference to the drawings.

Figure 2:
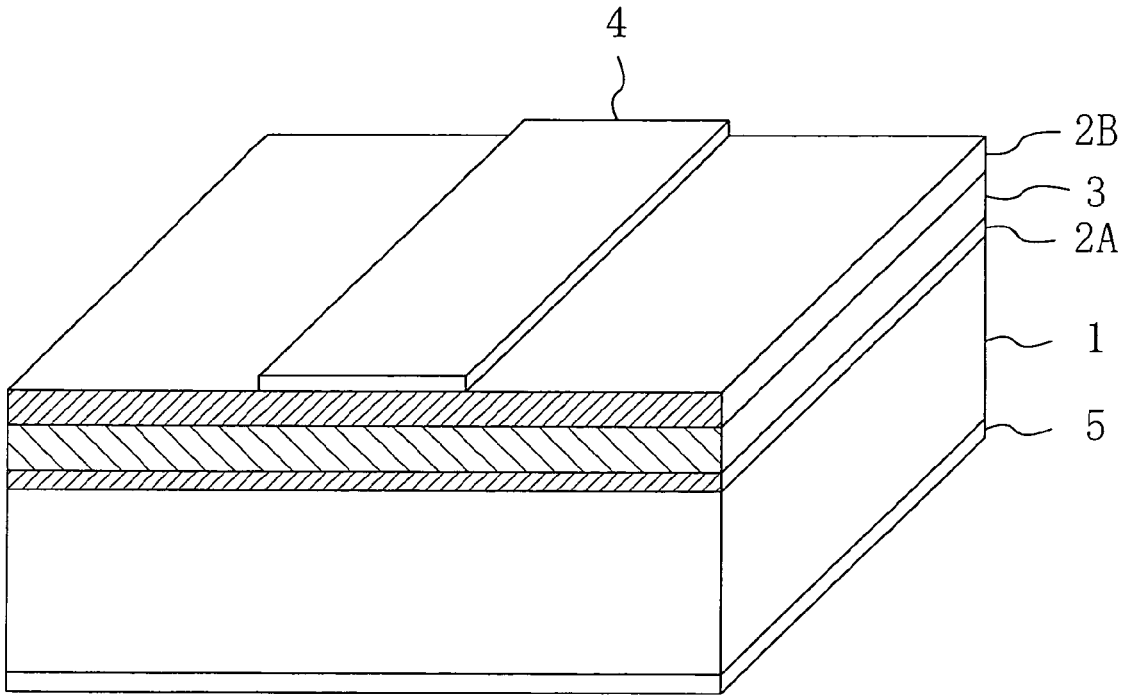
FIG. 2 is a cross-sectional perspective view illustrating a microwave transmission line according to a first modification of the first embodiment of the present invention, i.e., a microstrip line.

FIG. 2 partly illustrates the cross-sectional structure of a microwave transmission line according to a first modification of the first embodiment of the present invention, i.e., a microstrip line. Referring to FIG. 2, the same components as those shown in FIG. 1 are designated by the same reference numerals, and thus a description thereof is not given.

In the first embodiment depicted in FIG. 1, the potential neutralizing film 3 made of aluminum oxide is stacked on the protective film 2 made of silicon oxide. It is also considered that the differences between silicon oxide and aluminum oxide in the temperatures at which they are formed in films and their physical properties provide an imbalance between internal stresses caused in the protective film 2 and the potential neutralizing film 3. In this case, the protective film 2 or the potential neutralizing film 3 might peel off or cracks might be produced in the above films.

To cope with this, in the first modification depicted in FIG. 2, the following films are successively formed between a high-resistivity substrate 1 and a strip metal 4 in the order from the substrate side: a first protective film 2A made of silicon oxide; a potential neutralizing film 3 made of aluminum oxide; and a second protective film 2B made of silicon oxide. These films constitute a dielectric laminated film. In this way, the internal stresses caused in the dielectric laminated film are balanced among the films 2A, 3 and 2B. This can prevent each film from peeling off and cracks from being produced therein.

The thickness of the potential neutralizing film 3 is set such that potentials are neutralized in the vicinity of the top surface of the high-resistivity substrate 1 by interaction among the following charges: positive space charges located in the first protective film 2A; negative space charges located in the potential neutralizing film 3; positive space charges located in the second protective film 2B; and positive space charges produced at the interface between the first protective film 2A and the high-resistivity substrate 1 and arising from impurity ions implanted into the high-resistivity substrate 1. In this modification, for example, when the first protective film 2A and the second protective film 2B each have a thickness of 50 nm, the potential neutralizing film 3 has a thickness of approximately 550 nm.

In this way, according to the first modification, not only the effects of the first embodiment can be obtained but also the dielectric laminated film provided between the high-resistivity substrate 1 and the strip metal 4 can have improved stability.

(Modification 2 of Embodiment 1)

A second modification of the first embodiment of the present invention will be described hereinafter with reference to the drawings.

Figure 3:
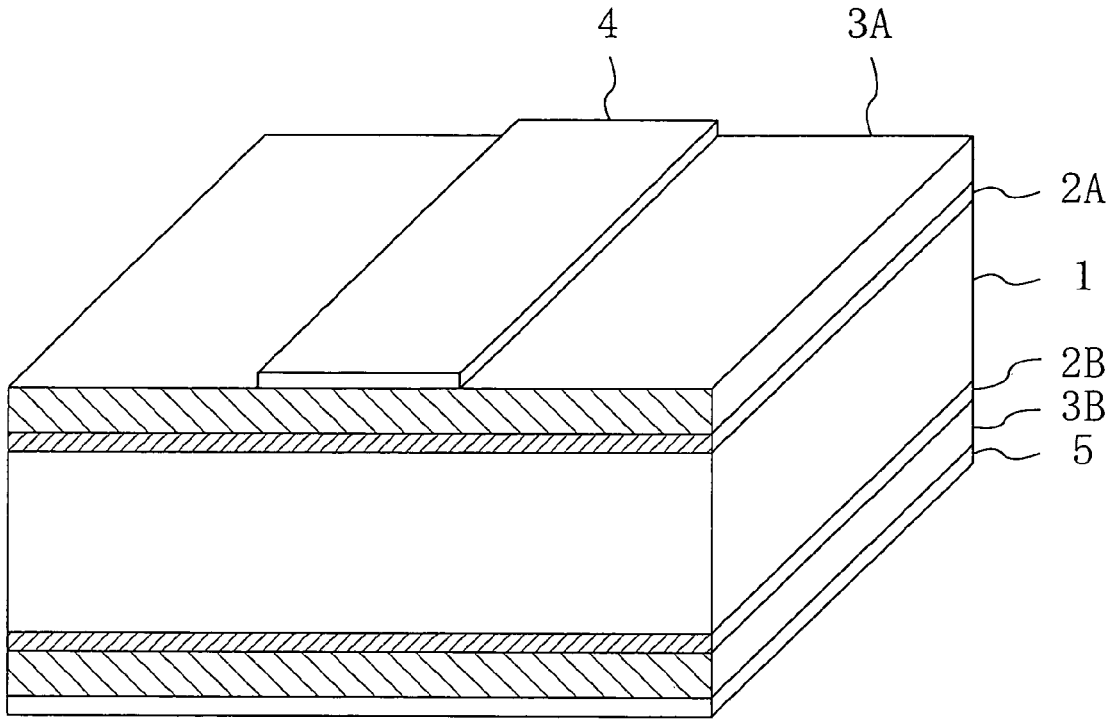
FIG. 3 is a cross-sectional perspective view illustrating a microwave transmission line according to a second modification of the first embodiment of the present invention, i.e., a microstrip line.

FIG. 3 partly illustrates the cross-sectional structure of a microwave transmission line according to a second modification of the first embodiment of the present invention, i.e., a microstrip line. Referring to FIG. 3, the same components as those shown in FIG. 1 are designated by the same reference numerals, and thus a description thereof is not given.

As illustrated in FIG. 3, the microwave transmission line according to the second modification has the following configuration. A first protective film 2A of silicon oxide and a first potential neutralizing film 3A of aluminum oxide are provided between a high-resistivity substrate 1 and a strip metal 4 in this order from the substrate side, and a second protective film 2B of silicon oxide and a second potential neutralizing film 3B of aluminum oxide are provided also between the high-resistivity substrate 1 and a grounding metal 5 in this order from the substrate side.

The thickness of the first potential neutralizing film 3A is set such that potentials are neutralized in the vicinity of the top surface of the high-resistivity substrate 1 by interaction among the following charges: positive space charges located in the first protective film 2A; negative space charges located in the first potential neutralizing film 3A; and positive space charges produced at the interface between the first protective film 2A and the high-resistivity substrate 1 and arising from impurity ions implanted into the high-resistivity substrate 1.

Likewise, the thickness of the second potential neutralizing film 3B is also set such that potentials are neutralized in the vicinity of the back surface of the high-resistivity substrate 1 by interaction among the following charges: positive space charges located in the second protective film 2B; negative space charges located in the second potential neutralizing film 3B; and positive space charges produced at the interface between the second protective film 2B and the high-resistivity substrate 1 and arising from impurity ions implanted into the high-resistivity substrate 1.

In this modification, for example, when the first protective film 2A and the second protective film 2B each have a thickness of 50 nm, the first potential neutralizing film 3A and the second potential neutralizing film 3B each have a thickness of approximately 500 nm.

In this way, according to the second modification, the second protective film 2B and the second potential neutralizing film 3B are intentionally provided also between the high-resistivity substrate 1 and the grounding metal 5. This can provide the capability to prevent a charge inversion layer from being produced on the back surface of the high-resistivity substrate 1 due to oxidation and contamination of the substrate caused by the exposure thereof to the atmosphere in a transmission line fabricating process. As a result, microwave transmission loss is expected to be further reduced.

Furthermore, metal atoms constituting the grounding metal 5 can be prevented from diffusing into the high-resistivity substrate 1.

(Embodiment 2)

A second embodiment of the present invention will be described hereinafter with reference to the drawings.

Figure 4:
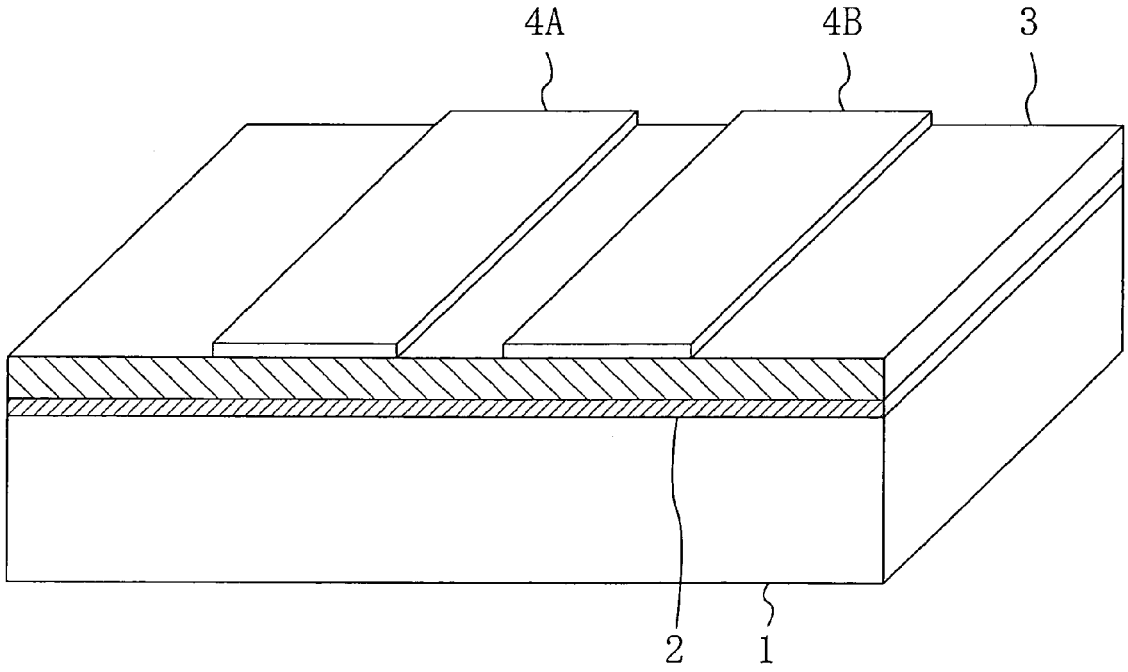
FIG. 4 is a cross-sectional perspective view illustrating a microwave transmission line according to a second embodiment of the present invention, i.e., a strip line.

FIG. 4 partly illustrates the cross-sectional structure of a microwave transmission line according to a second embodiment of the present invention, i.e., a strip line.

As illustrated in FIG. 4, an approximately 50-nm-thick protective film 2 of silicon oxide serving as a first dielectric film and an approximately 500-nm-thick potential neutralizing film 3 of aluminum oxide serving as a second dielectric film are successively formed on the principal surface of a high-resistivity substrate 1 of high-resistivity $p^-$-type silicon having a majority carrier (hole) density of approximately $1\times10^{13}$ $cm^{-3}$ or less.

A first strip metal 4A and a second strip metal 4B, for example, both made of gold, aluminum or the like, are formed approximately 30 μm away from each other on the potential neutralizing film 3 to each have a width of approximately 100 μm.

In this way, a strip line using, as signal propagation media, the high-resistivity substrate 1 of $p^-$-type silicon, the protective film 2 of silicon oxide and the potential neutralizing film 3 of aluminum oxide is formed of the first strip metal 4A and the second strip metal 4B.

For the microwave transmission line according to the second embodiment, two balanced signals with their potential phases inverted by 180 degrees are usually applied to a region between the first strip metal 4A and the second strip metal 4B. This allows a signal electric field to be localized between the strip metals 4A and 4B, resulting in the enhanced effect of restraining a charge inversion layer from being produced at the interface between the substrate 1 and the protective film 2.

Also in this embodiment, the thickness of the potential neutralizing film 3 is set such that potentials are neutralized in the vicinity of the top surface of the high-resistivity substrate 1 by interaction among the following charges: positive space charges located in the protective film 2 and, for example, arising from Na ions; negative space charges located in the potential neutralizing film 3; and positive space charges produced at the interface between the protective film 2 and the high-resistivity substrate 1 and arising from impurity ions implanted into the high-resistivity substrate 1. With this structure, carriers are not stored in the vicinity of the interface between the high-resistivity substrate 1 and the protective film 2. This can provide the capability to prevent a charge inversion layer from being produced in the vicinity of the interface. As a result, the stacked protective film 2 and potential neutralizing film 3 of the strip line according to the second embodiment can prevent transmission loss from increasing with long-term stability maintained.

Furthermore, a material of the potential neutralizing film 3 is not limited to aluminum oxide and may be a dielectric material having negative space charges. For example, aluminum nitride (AlN) can be used thereas.

(Embodiment 3)

A third embodiment of the present invention will be described hereinafter with reference to the drawings.

Figure 5:
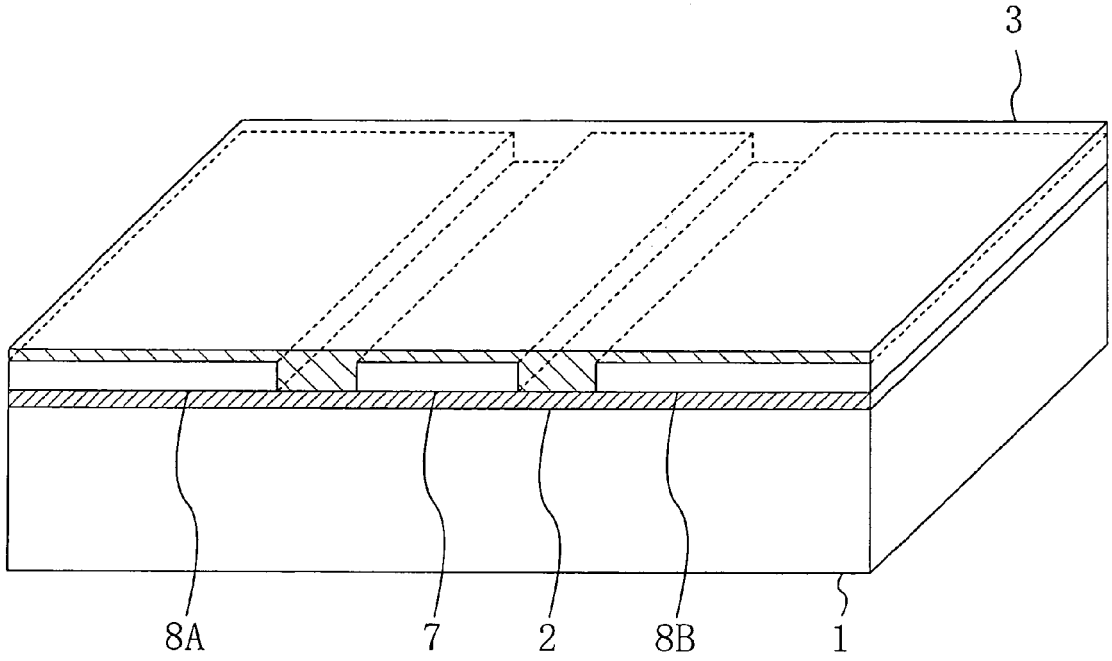
FIG. 5 is a cross-sectional perspective view illustrating a microwave transmission line according to a third embodiment of the present invention, i.e., a coplanar waveguide line.

FIG. 5 partly illustrates the cross-sectional structure of a microwave transmission line according to the third embodiment of the present invention, i.e., a coplanar waveguide line.

As illustrated in FIG. 5, an approximately 50-nm-thick protective film 2 of silicon oxide serving as a first dielectric film is formed on the principal surface of a high-resistivity substrate 1 of high-resistivity $p^-$-type silicon having a majority carrier (hole) density of approximately $1\times10^{13}$ $cm^{-3}$ or less.

An approximately 40-μm-wide center conductor strip 7, for example, made of gold (Au), aluminum (Al) or the like, and grounding conductor films 8A and 8B are formed on the protective film 2. The grounding conductor films 8A and 8B are formed approximately 30 μm apart from both sides of the center conductor strip 7, respectively.

Furthermore, a potential neutralizing film 3 of aluminum oxide serving as a second dielectric film is formed to cover the center conductor strip 7, the grounding conductor films 8A and 8B, and parts of the top surface of the protective film 2 exposed at the regions located between the center conductor strip 7 and the grounding conductor film 8A and between the center conductor strip 7 and the grounding conductor film 8B, respectively. In this case, parts of the potential neutralizing film 3 located on the protective film 2 each have a thickness of approximately 500 nm.

For the microwave transmission line according to the third embodiment, the regions located between the center conductor strip 7 and both the grounding conductor films 8A and 8B formed to the associated sides of the center conductor strip 7 serves as signal propagation medium parts of the microwave transmission line, i.e., parts thereof having a high signal electric field intensity. The potential neutralizing film 3 of aluminum oxide is provided in the part thereof having a high signal electric field intensity. With this structure, parts of the potential neutralizing film 3 located in the gaps between the center conductor strip 7 and both the grounding conductor films 8A and 8B restrain a charge inversion layer from being produced in the vicinity of the top surface of the high-resistivity substrate 1.

Since the potential neutralizing film 3 is formed to cover the center conductor strip 7 and the grounding conductor films 8A and 8B, parts of the potential neutralizing film 3 located immediately above the center conductor strip 7 and the grounding conductor films 8A and 8B function as protective films for the center conductor strip 7 and the grounding conductor films 8A and 8B, respectively.

Also in this embodiment, the thickness of the potential neutralizing film 3 is set such that potentials are neutralized in the vicinity of the top surface of the high-resistivity substrate 1 by interaction among the following charges: positive space charges located in the protective film 2 and, for example, arising from Na ions; negative space charges located in the potential neutralizing film 3; and positive space charges produced at the interface between the protective film 2 and the high-resistivity substrate 1 and arising from impurity ions implanted into the high-resistivity substrate 1. With this structure, carriers are not stored in parts of the vicinity of the top surface of the high-resistivity substrate 1 located in the gaps between the center conductor strip 7 and both the grounding conductor films 8A and 8B. This can provide the capability to prevent a charge inversion layer from being produced in the parts thereof located in the gaps. As a result, the stacked protective film 2 and potential neutralizing film 3 of the coplanar waveguide line according to the third embodiment can prevent transmission loss from increasing with long-term stability maintained.

Charge inversion layers are produced in a part of the vicinity of the high-resistivity substrate 1 located under the center conductor strip 7 and parts thereof located under the grounding conductor films 8A and 8B, respectively. This has an extremely small influence on signal propagation. The reason for this is that a low-resistivity charge inversion layer originally exists under a conductor.

Furthermore, a material of the potential neutralizing film 3 is not limited to aluminum oxide and may be a dielectric material having negative space charges. For example, aluminum nitride (AlN) can be used thereas.

(Embodiment 4)

A fourth embodiment of the present invention will be described hereinafter with reference to the drawings.

Figure 6:
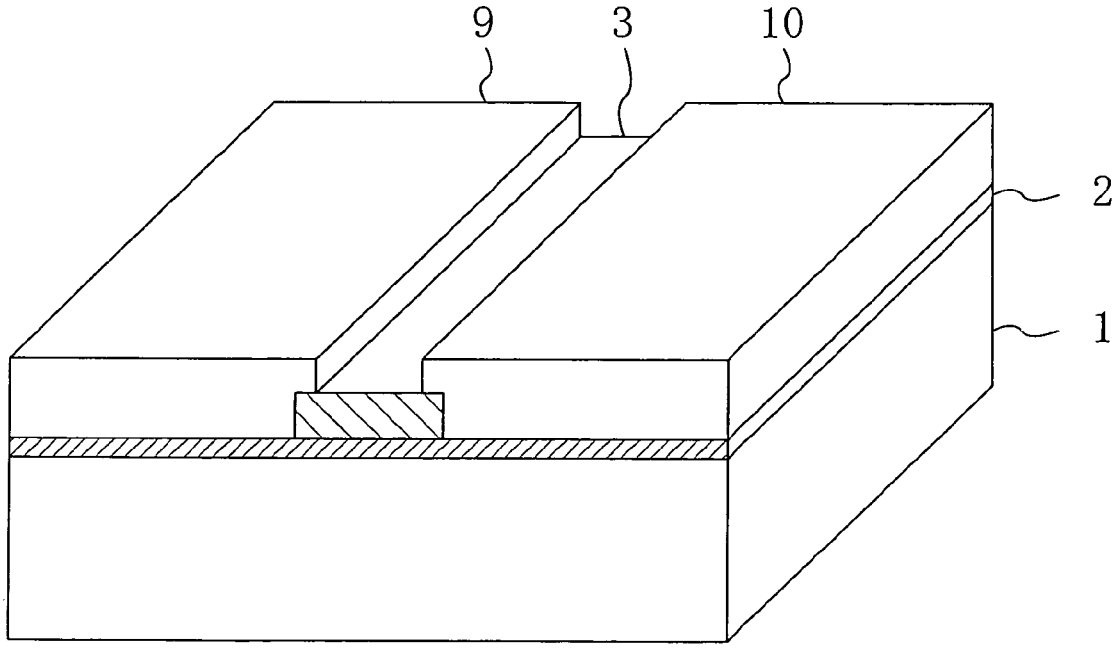
FIG. 6 is a cross-sectional perspective view illustrating a microwave transmission line according to a fourth embodiment of the present invention, i.e., a slot line.

FIG. 6 partly illustrates the cross-sectional structure of a microwave transmission line according to the fourth embodiment of the present invention, i.e., a slot line.

As illustrated in FIG. 6, an approximately 50-nm-thick protective film 2 of silicon oxide serving as a first dielectric film is formed on the principal surface of a high-resistivity substrate 1 of high-resistivity $p^-$-type silicon having a majority carrier (hole) density of approximately $1\times10^{13}$ $cm^{-3}$ or less.

A first conductor film 9 and a second conductor film 10, for example, made of gold (Au), aluminum (Al) or the like, are formed approximately 50 μm apart from each other on the protective film 2.

For the microwave transmission line according to the fourth embodiment, the region located between the first conductor film 9 and the second conductor film 10 serves as a signal propagation medium part of the microwave transmission line, i.e., a part thereof having a high signal electric field intensity. Therefore, a potential neutralizing film 3 of aluminum oxide is provided in the part thereof having a high signal electric field intensity. With this structure, the potential neutralizing film 3 located in the gap between the first conductor film 9 and the second conductor film 10 restrain a charge inversion layer from being produced in the vicinity of the top surface of the high-resistivity substrate 1.

Also in this embodiment, the thickness of the potential neutralizing film 3 is set such that potentials are neutralized in the vicinity of the top surface of the high-resistivity substrate 1 by interaction among the following charges: positive space charges located in the protective film 2 and, for example, arising from Na ions; negative space charges located in the potential neutralizing film 3; and positive space charges produced at the interface between the protective film 2 and the high-resistivity substrate 1 and arising from impurity ions implanted into the high-resistivity substrate 1. With this structure, carriers are not stored in a part of the vicinity of the top surface of the high-resistivity substrate 1 located in the gap between the first conductor film 9 and the second conductor film 10. This can provide a charge inversion layer from being produced in the part thereof located in the gap. As a result, the stacked protective film 2 and potential neutralizing film 3 of the slot line according to the fourth embodiment can prevent transmission loss from increasing with long-term stability maintained.

Furthermore, a material of the potential neutralizing film 3 is not limited to aluminum oxide and may be a dielectric material having negative space charges. For example, aluminum nitride (AlN) can be used thereas.

(Embodiment 5)

A fifth embodiment of the present invention will be described hereinafter with reference to the drawings.

Figure 7:
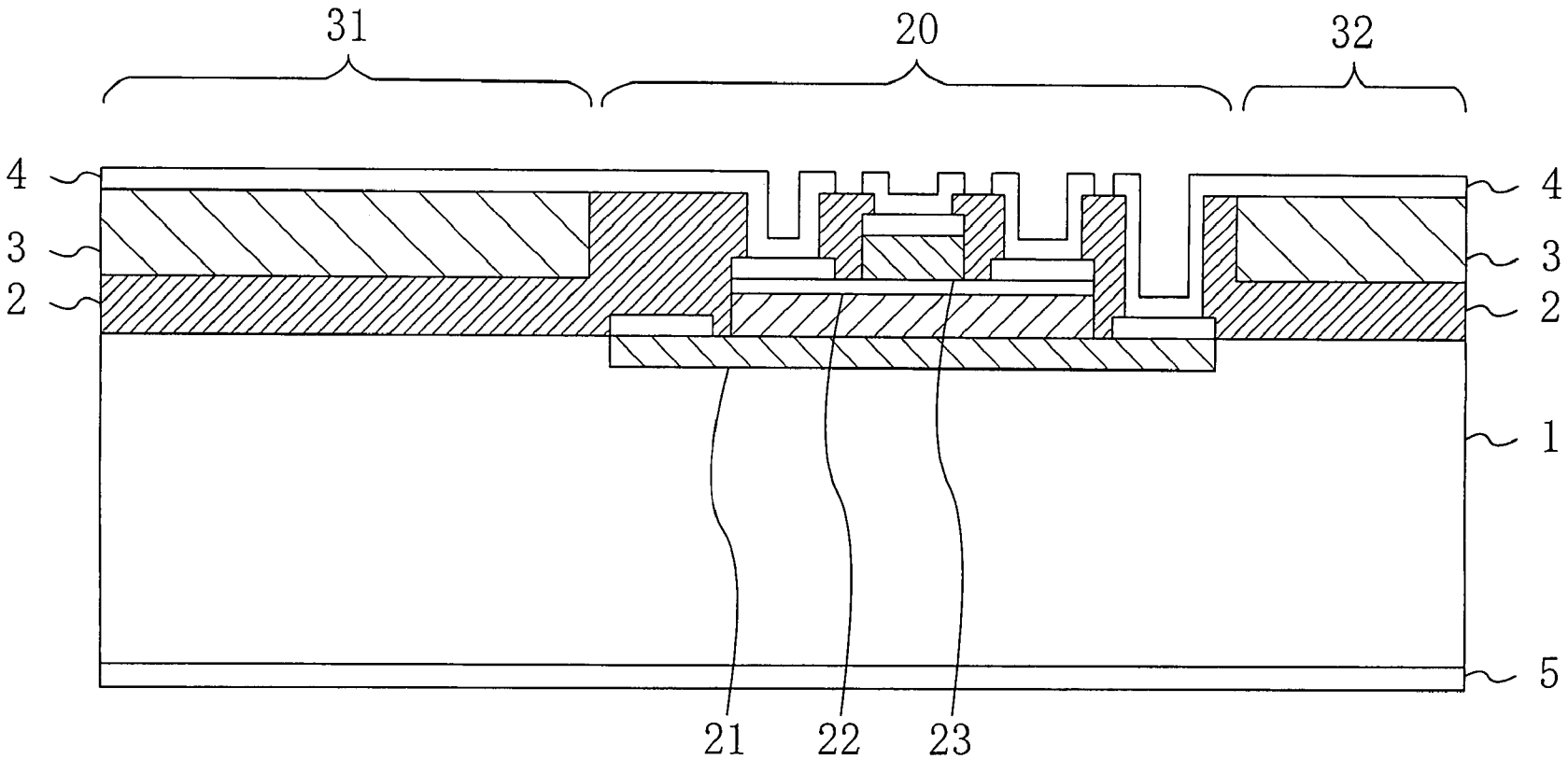
FIG. 7 is a cross-sectional view illustrating a high-frequency integrated circuit device using a microwave transmission line according to a fifth embodiment of the present invention.

FIG. 7 partly illustrates the cross-sectional structure of a high-frequency integrated circuit device using a microwave transmission line according to the fifth embodiment of the present invention. Referring to FIG. 7, the same components as those shown in FIG. 1, including strip metal 4 and grounding metal 5 are designated by the same reference numerals, and thus a description thereof is not given.

As illustrated in FIG. 7, the high-frequency integrated circuit device of the fifth embodiment includes an npn bipolar transistor 20 composed of an n-type collector layer 21 formed in the upper part of a high-resistivity substrate 1 of $p^-$-type silicon and a p-type base layer 22 and an n-type emitter layer 23 successively stacked on the n-type collector layer 21.

Figure 8:
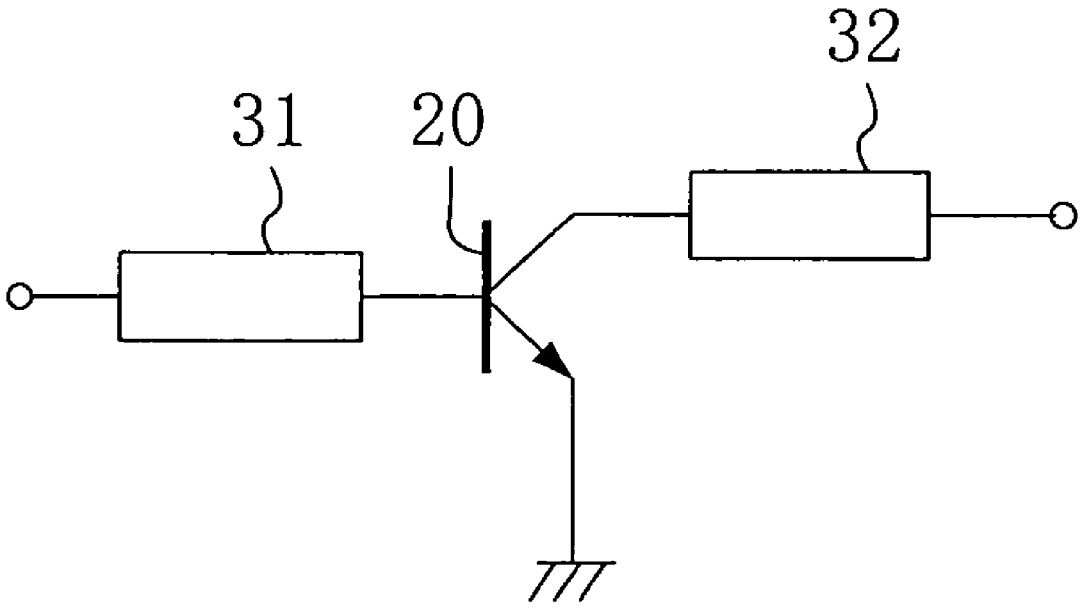
FIG. 8 is a circuit diagram illustrating the high-frequency integrated circuit device using the microwave transmission line according to the fifth embodiment of the present invention.

The p-type base layer 22 of the npn bipolar transistor 20 is formed above the high-resistivity substrate 1, and the n-type collector layer 21 thereof is formed in the high-resistivity substrate 1. The p-type base layer 22 and the n-type collector layer 21 are connected to a first microstrip line 31 and a second microstrip line 32, respectively, each having the same structure as the microstrip line according to the first embodiment. Furthermore, although not shown, the n-type emitter layer 23 is grounded. FIG. 8 is a circuit diagram schematically illustrating transistor 20 and first and second microstrip lines 31, 32.

For the high-frequency integrated circuit device of the fifth embodiment, the provision of both the first microstrip line 31 and the second microstrip line 32 prevents carriers from being stored in the vicinity of the interface between the high-resistivity substrate 1 and the protective film 2. This can restrain a charge inversion layer reducing the resistivity of the high-resistivity substrate 1 from being produced in the vicinity of the interface. As a result, the stacked protective film 2 and potential neutralizing film 3 of the high-frequency integrated circuit device according to this embodiment can prevent transmission loss from increasing with long-term stability maintained.

The npn bipolar transistor 20 in a description of the integrated circuit device of the fifth embodiment is given as an example. In addition to the npn bipolar transistor 20, a field-effect transistor, a diode, an inductor, a capacitor, a resistor element, or the like can also be integrated into the integrated circuit device. Thus, a high-frequency integrated circuit with low transmission loss can be formed on the high-resistivity substrate 1.

Furthermore, the configuration of each microstrip line 31, 32 is not limited to that of the microwave transmission line according to the first embodiment and may be any one of the microwave transmission lines according to modifications of the first embodiment and the second through fourth embodiments.

As described above, according to the microwave transmission line of the present invention, potentials in the vicinity of the principal surface of the substrate are combined and thus neutralized by interaction between positive space charges and negative space charges produced by the first and second dielectric films, respectively, located on the substrate. This prevents carriers from being stored in the vicinity of the principal surface of the substrate. Therefore, a charge inversion layer reducing the resistivity of the substrate will not be formed in the vicinity of the principal surface of the substrate. This can prevent transmission loss from increasing with long-term reliability maintained. In view of the above, the microwave transmission line of the present invention is useful when a 5-GHz-or-more microwave is treated in applications for integrating an IF circuit and a signal processing circuit with a microwave front-end circuit used for a microwave radio communication apparatus and terminal. Furthermore, it can be applied also to a micromechanical device or the like using a silicon substrate.

What is claimed is:

1. A microwave transmission line comprising:

a substrate of high-resistivity silicon;

a first dielectric film made of silicon oxide having positive space charges and a second dielectric film made of aluminum oxide or aluminum nitride having negative space charges, both successively formed on the principle surface of the substrate on the principal surface of the substrate and; and a conductor film formed with at least the first dielectric film interposed between the conductor film and the substrate, wherein a signal electric field propagates through the substrate, the first dielectric film and the second dielectric film.

2. The microwave transmission line of claim 1 further comprising grounding conductor films formed to both sides of the conductor film on the principal surface of the substrate, respectively, said grounding conductor films being formed apart from the conductor film.

3. The microwave transmission line of claim 2, wherein the second dielectric film is formed only in a region having a high signal electric field intensity.

4. The microwave transmission line of claim 1, wherein the conductivity type of the substrate is a p type, and the substrate has a majority carrier density of $1\times10^{13}$ cm-3 or less.

5. The microwave transmission line of claim 1, wherein the first and second dielectric films are stacked alternately one after the other to neutralize potentials in the vicinity of the principal surface of the substrate.

6. The microwave transmission line of claim 1, wherein the second dielectric film is formed only in a region having a high signal electric field intensity.

7. The microwave transmission line of claim 1 further comprising a grounding conductor film formed on the opposite surface of the substrate to the principal surface thereof.

8. The microwave transmission line of claim 7 further comprising a third dielectric film made of silicon oxide having positive space charges and a fourth dielectric film made of aluminum oxide or aluminum nitride having negative space charges, both successively formed between the substrate and the grounding conductor film.

9. The microwave transmission line of claim 1, wherein the conductor film is connected to at least one of a transistor, a diode, a resistor element, a capacitor element, and an inductor element all formed on the principal surface of the substrate.

10. The microwave transmission line of claim 1, wherein the conductor film is composed of a first conductor film and a second conductor film formed apart from and parallel to each other on the principal surface of the substrate.

11. The microwave transmission line of claim 10, wherein the second dielectric film is formed only in a region having a high signal electric field intensity.

* * * * *